US012663156B2

(12) United States Patent
Schaiper et al.

(10) Patent No.: US 12,663,156 B2
(45) Date of Patent: Jun. 23, 2026

(54) GAS COOKTOP ASSEMBLY AND QUICK-CONNECT STRUCTURE

(71) Applicant: Haier US Appliance Solutions, Inc., Wilmington, DE (US)

(72) Inventors: Benjamin Schaiper, Cincinnati, OH (US); Ian Moloney, Wilmette, IL (US); Dominic Kenney, Louisville, KY (US); Camden Zeese, New Carlisle, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 295 days.

(21) Appl. No.: 18/508,672

(22) Filed: Nov. 14, 2023

(65) Prior Publication Data

US 2025/0155128 A1 May 15, 2025

(51) Int. Cl.
*F24C 3/08* (2006.01)

(52) U.S. Cl.
CPC ..... *F24C 3/085* (2013.01)

(58) Field of Classification Search
CPC ..... F24C 3/085
USPC ..... 126/39 R
See application file for complete search history.

(56) References Cited

U.S. PATENT DOCUMENTS

| | | | | |
|---|---|---|---|---|
| 2,035,060 | A * | 3/1936 | Fox | F24C 3/12 126/42 |
| 4,409,954 | A * | 10/1983 | Berlik | F24C 3/103 126/39 M |
| 6,820,537 | B2 | 11/2004 | Patenotre | |
| 7,798,139 | B2 | 9/2010 | Gagas et al. | |
| 2006/0289450 | A1* | 12/2006 | Craghead | F24C 15/30 219/445.1 |
| 2013/0327315 | A1* | 12/2013 | Sosso | F24C 15/2042 126/299 D |
| 2022/0205642 | A1* | 6/2022 | Graham, Jr. | F24C 3/085 |

FOREIGN PATENT DOCUMENTS

| | | | |
|---|---|---|---|
| CN | 208936236 | U | 6/2019 |
| CN | 111829040 | B | 5/2022 |
| DE | 202020107236 | U1 | 1/2021 |
| KR | 200238428 | Y1 | 10/2001 |

* cited by examiner

*Primary Examiner* — Avinash A Savani
(74) *Attorney, Agent, or Firm* — Dority & Manning, P.A.

(57) ABSTRACT

A gas cooktop assembly including a burner housing and a base housing is provided. The burner housing includes an articulation mechanism configured to translate a first body at the burner housing. The base housing forms a basin into which the burner housing is receivable. The base housing includes a second body to which the first body is translatable to articulate an adapter. The adapter is connected to a gas coupling. Articulation of the adapter connects or disconnects the gas coupling and a gas conduit.

18 Claims, 8 Drawing Sheets

GAS COOKTOP ASSEMBLY AND QUICK-CONNECT STRUCTURE

FIELD

The present disclosure relates generally to gas cooktops, and more particularly to structures and methods for connecting gas cooktops to gas supply.

BACKGROUND

Gas cooktops, such as portable gas cooktops for recreational vehicles or outdoor cooking, require connection and disconnection to a gas supply, such as a propane tank. Structures and methods for facilitating connection and disconnection of the gas cooktop to the gas supply would be beneficial and advantageous. Additionally, structures and methods for facilitating quick and thorough connection and disconnection of the gas cooktop to the gas supply would be beneficial and advantageous.

BRIEF DESCRIPTION

Aspects and advantages of the invention will be set forth in part in the following description, may be apparent from the description, or may be learned through practice of the invention.

An aspect of the present disclosure is directed to a gas cooktop assembly including a burner housing and a base housing is provided. The burner housing includes an articulation mechanism configured to translate a first body at the burner housing. The base housing forms a basin into which the burner housing is receivable. The base housing includes a second body to which the first body is translatable to articulate an adapter. The adapter is connected to a gas coupling. Articulation of the adapter connects or disconnects the gas coupling and a gas conduit.

Another aspect of the present disclosure is directed to a gas cooktop assembly including a burner assembly and a base. The burner assembly includes a burner housing and a burner. The burner housing includes a pair of sidewalls separated from one another along a longitudinal direction. An articulation mechanism is positioned at each sidewall and configured to translate a first body at the burner housing. The burner assembly includes a gas conduit coupled in fluid communication with the burner. The base is selectively attachable to the burner assembly. The base includes a base housing forming a basin into which the burner assembly is receivable. The base includes a second body to which the first body is translatable along a vertical direction to articulate an adapter. The adapter extends along the longitudinal direction in connection to a gas coupling. Articulation of the adapter along the vertical direction connects or disconnects the gas coupling and the gas conduit at the burner assembly. Articulation of the adapter attaches or detaches the base from the burner assembly.

These and other features, aspects and advantages of the present disclosure will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
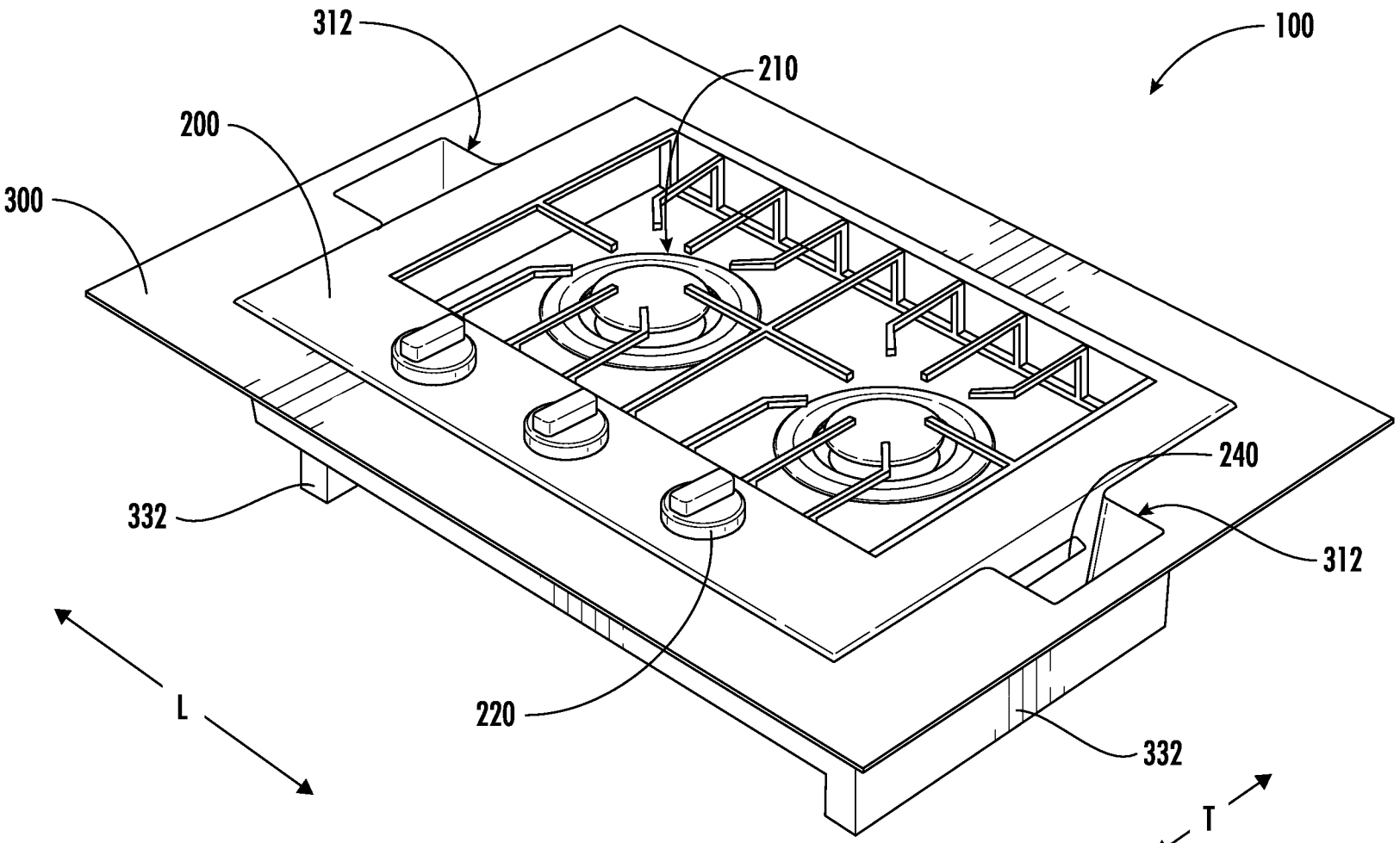
FIG. 1 depicts a perspective view of an embodiment of the gas cooktop assembly in accordance with aspects of the present disclosure.
Figure 2:
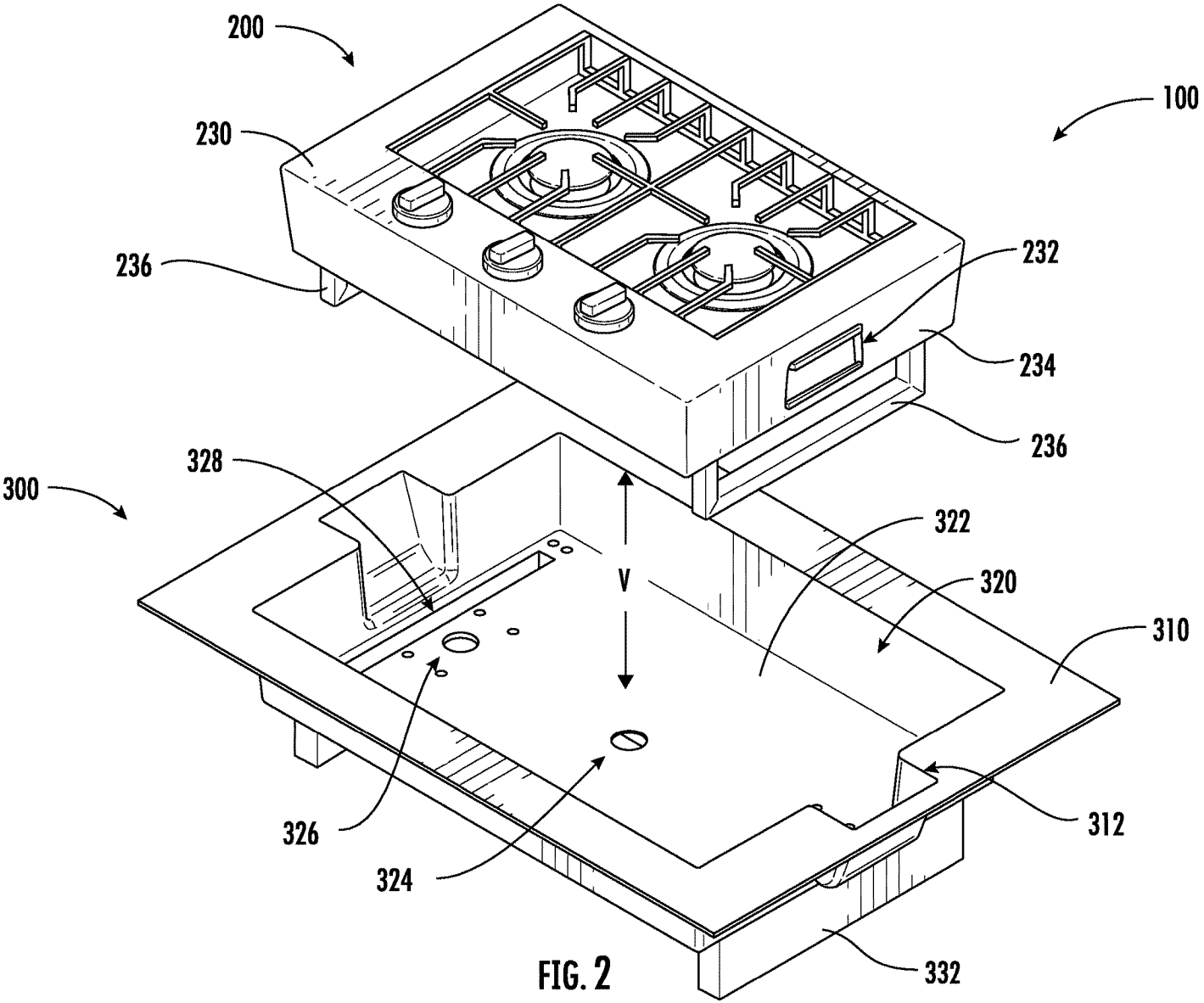
FIG. 2 depicts an exploded view of an embodiment of the gas cooktop assembly in accordance with aspects of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Embodiments of a gas cooktop including structures for quick connection and disconnection to a gas supply are provided herein that address one or more of the aforementioned issues. Embodiments provided herein allow for portability of the gas cooktop, obviate a need for using tools (e.g., hand tools, wrenches, drivers, etc.) for connection or disconnection at the gas supply, removes a need for a secondary outdoor gas cooktop appliance, and may facilitate common connection mechanisms for a recreational vehicle gas cooktop and outdoor gas cooktop (e.g., outdoor grill).

Referring now to the drawings, FIGS. 1-8 depict an exemplary embodiment of a gas cooktop assembly 100 in accordance with aspects of the present disclosure. Embodiments of the gas cooktop assembly 100 include a burner assembly 200 and a base 300.

The burner assembly 200 includes a burner housing 230 at which a burner 210 is positioned. The housing 230 may further include grills, griddles, or other surfaces for receiving utensils (e.g., pots, pans, etc.) or cooktop surfaces. The burner 210 is configured to generate a flame from a flow of gaseous fuel, such as may generally be understood for a gas cooktop appliance. The burner assembly 200 includes a control mechanism 220, such as a dial or other apparatus, configured to ignite the burner 210 and/or adjust an intensity of the flame at the burner 210, such as via adjusting the flow of gaseous fuel at the burner 210. Although the embodiments depicted include two (2) burners 210, it should be appreciated that any desired quantity of burners may be included. Any appropriate igniter structure may be included and operably connected to the control mechanism 220, burner 210, or both. Additionally, it should be appreciated that other surfaces, such as griddle surfaces, may be included at the burner assembly 200.

Figure 7B:
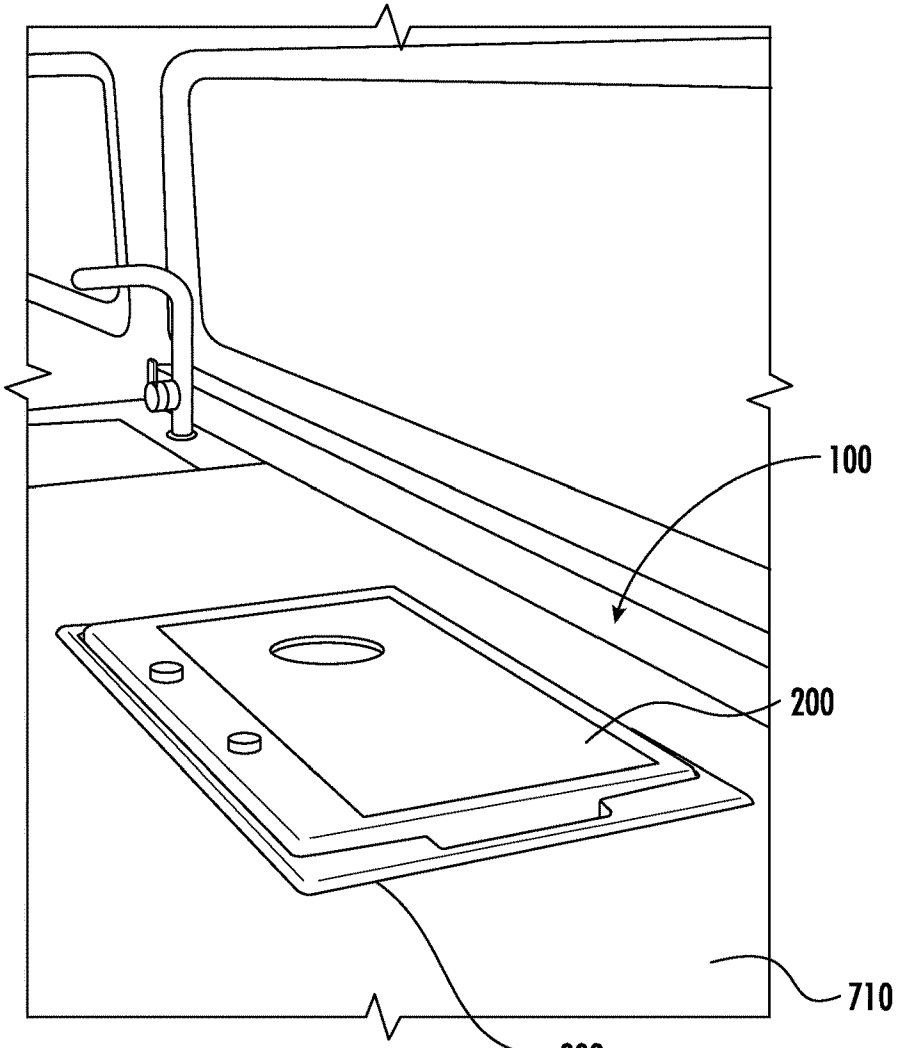
FIG. 7B depicts a perspective view of an embodiment of the gas cooktop assembly in accordance with aspects of the present disclosure.
Figure 7A:
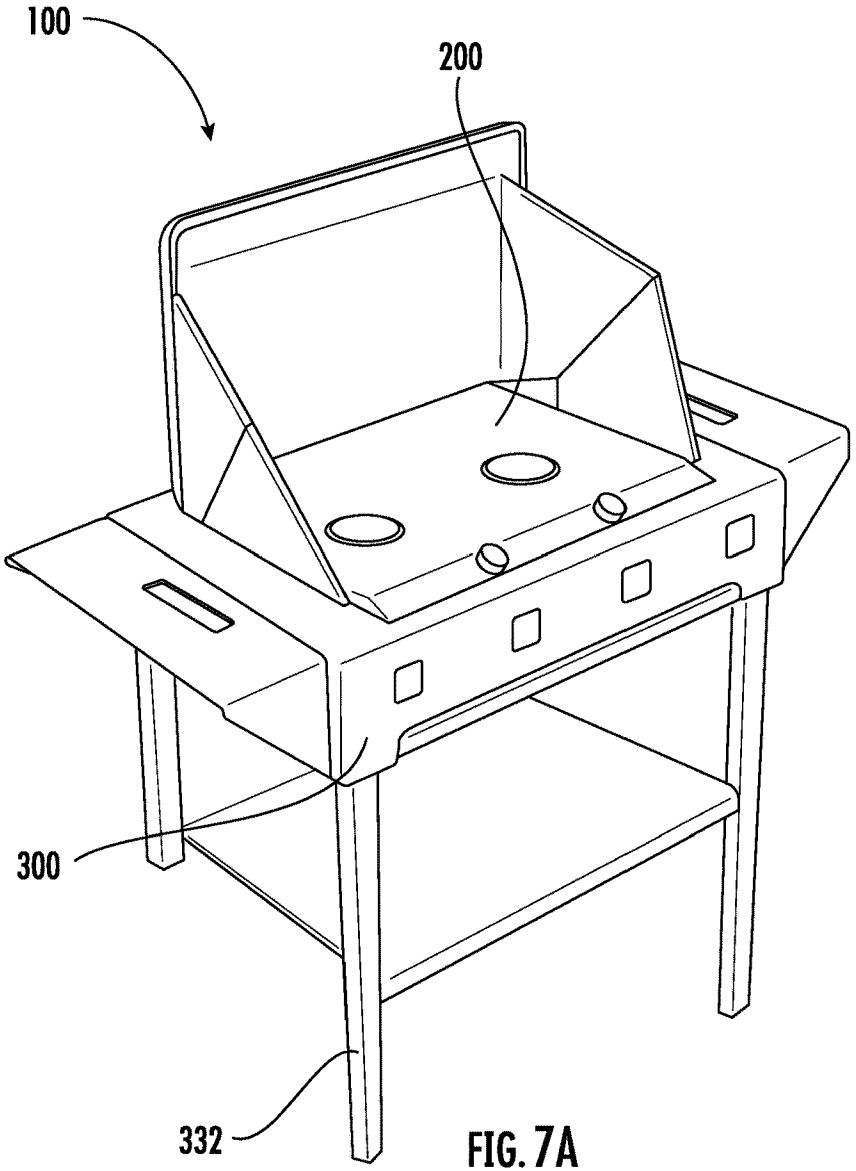
FIG. 7A depicts a perspective view of an embodiment of the gas cooktop assembly in accordance with aspects of the present disclosure.

The base 300 forms a base housing 310 at configured to receive the burner assembly 200. The base housing 310 forms a trough or basin 320 into which the burner housing 230 is receivable. The base 300 may form a portable structure, such as for outdoor cooking (e.g., an outdoor grill or griddle, such as depicted in FIG. 7A), or may be integrated into a countertop structure (e.g., within a recreational vehicle, a home, an indoor structure, etc., such as depicted in FIG. 7B).

Figure 3:
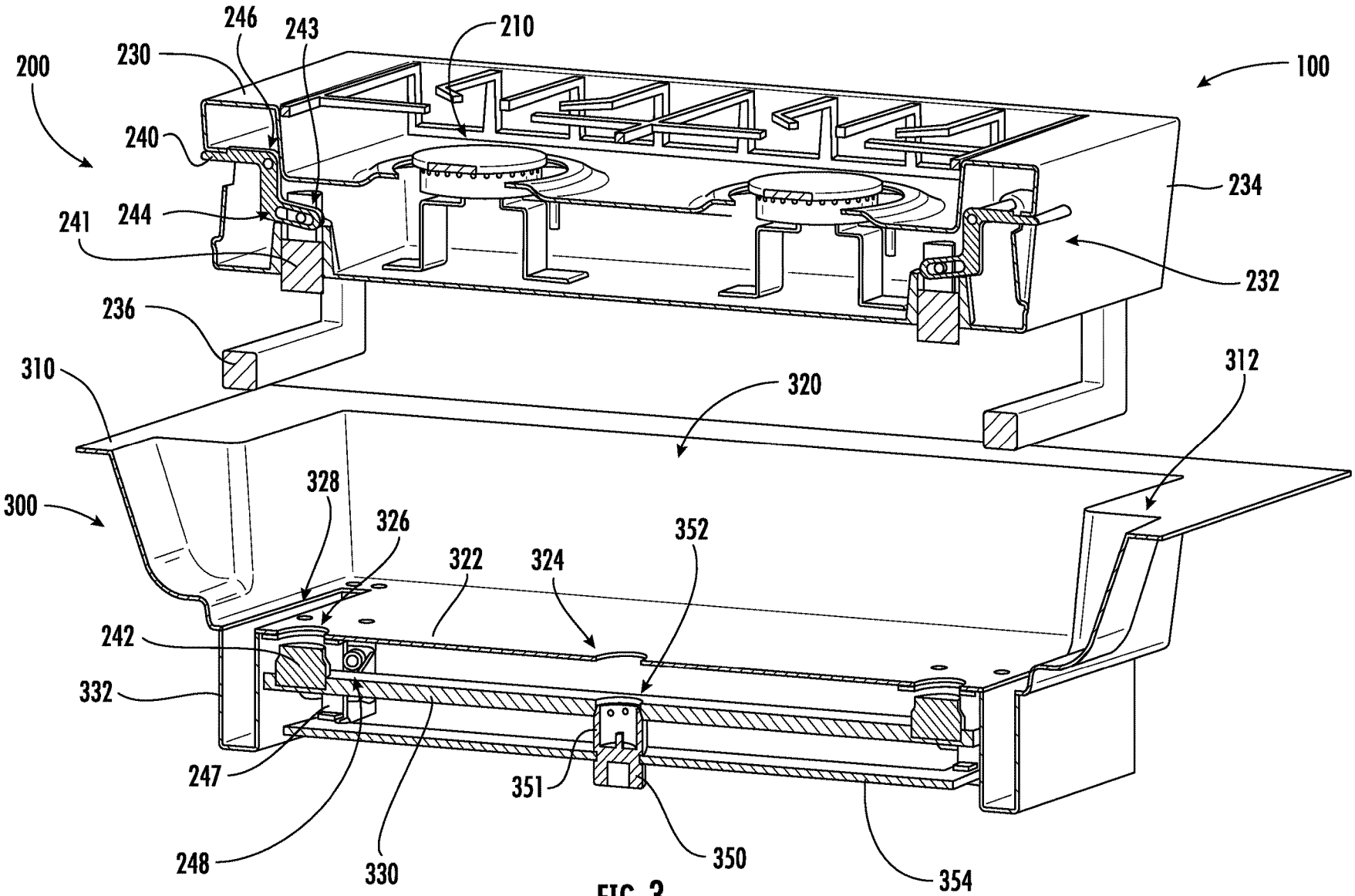
FIG. 3 depicts an exploded cutaway view of an embodiment of the gas cooktop assembly in accordance with aspects of the present disclosure.
Figure 4:
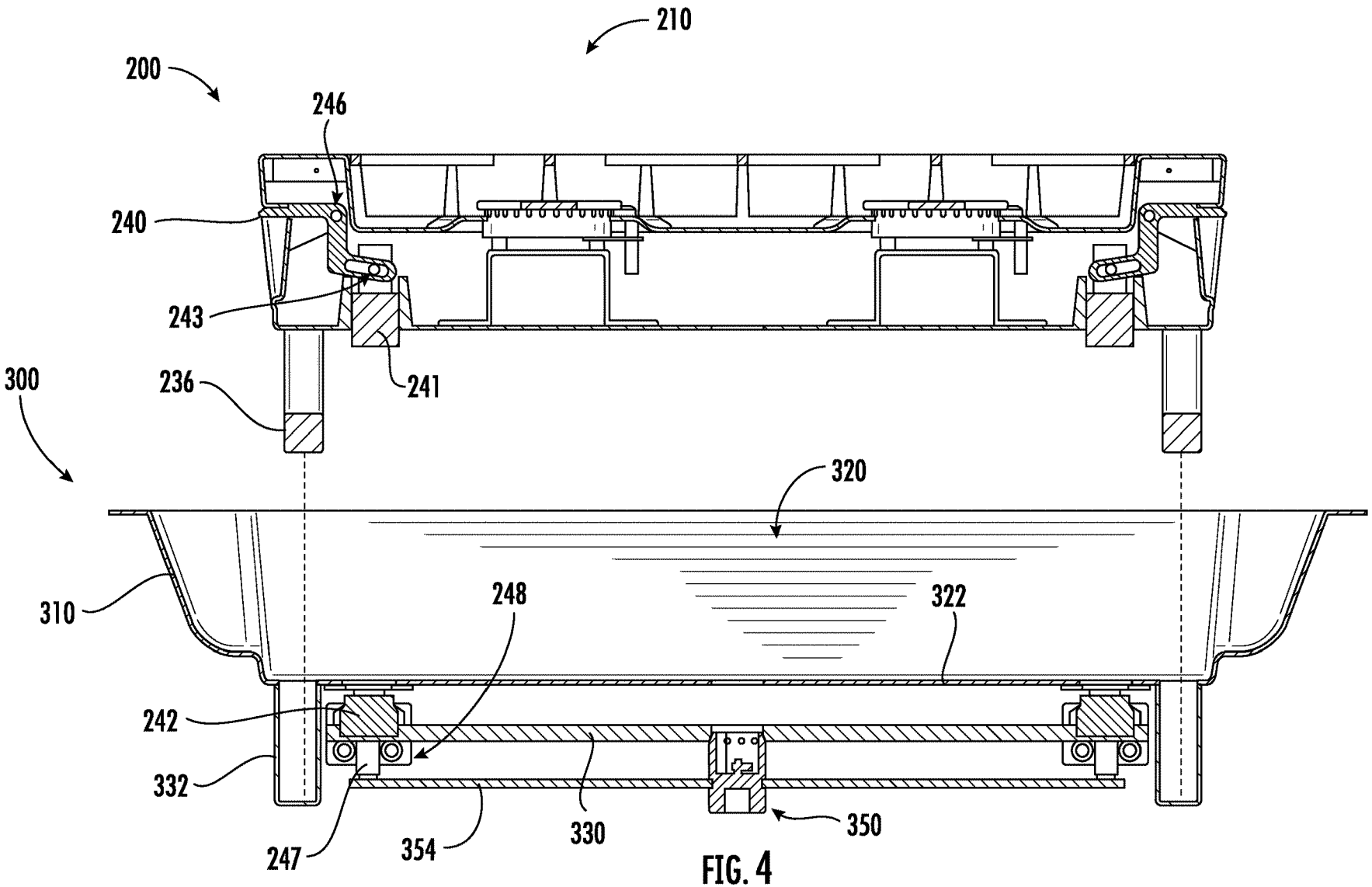
FIG. 4 depicts a side cutaway view of components an embodiment of the gas cooktop assembly in accordance with aspects of the present disclosure.
Figure 5:
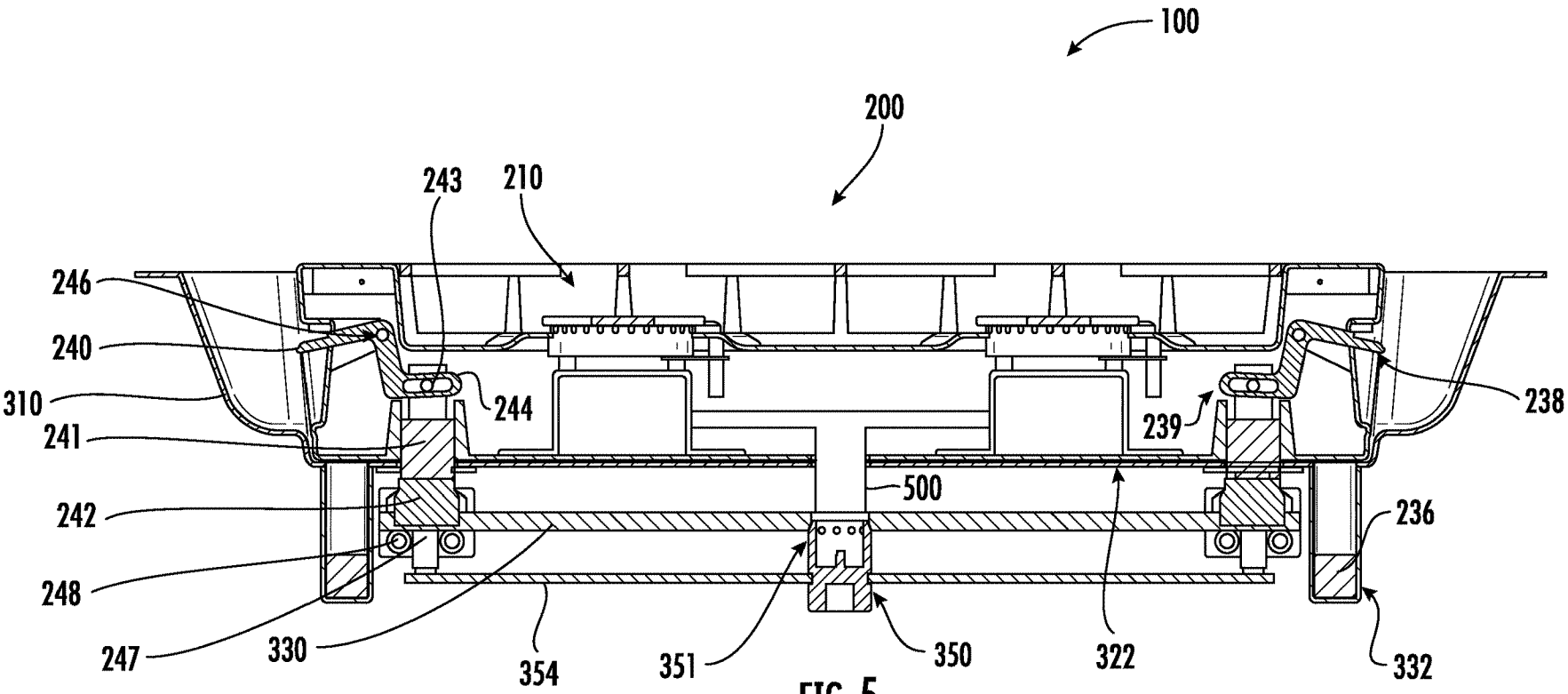
FIG. 5 depicts a side cutaway view of an embodiment of the gas cooktop assembly in accordance with aspects of the present disclosure.
Figure 8:
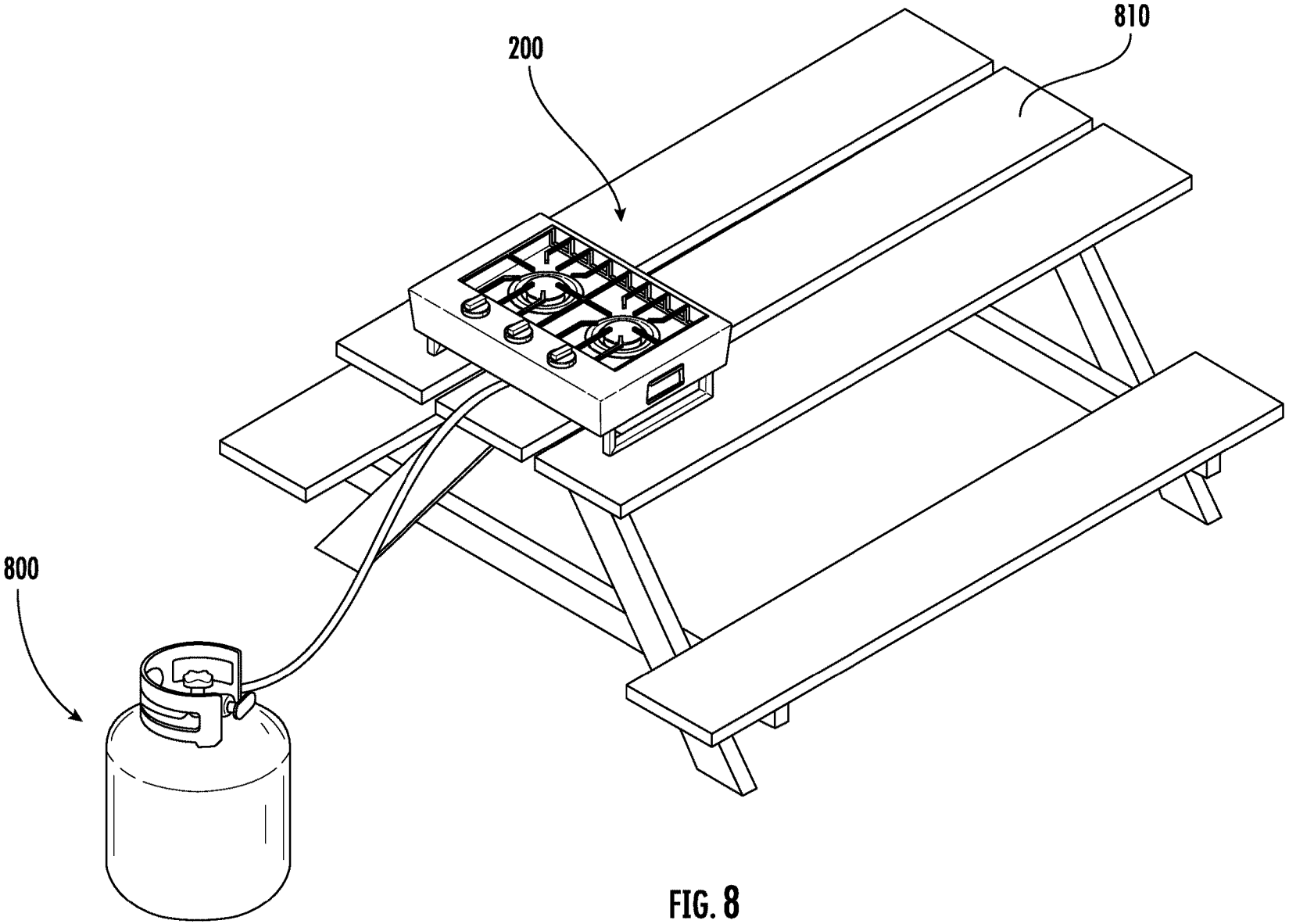
FIG. 8 depicts a perspective view of an embodiment of a burner assembly of the gas cooktop assembly in accordance with aspects of the present disclosure.

Referring to FIGS. 3-5, the burner assembly 200 includes an articulation mechanism 240 configured to translate a first body 241 at the burner assembly 200 toward a second body 242 at the base 300. The second body 242 is coupled to a gas coupling 350. The coupling 350 may form a quick-connect or quick-disconnect mechanism through which gaseous fuel is flowed from a gas supply 800 (FIG. 8).

In various embodiments, the base 300 includes an adapter 330 coupling the coupling 250 to the second body 242. The adapter 330 may form a bar, beam, rod, or other member extending longitudinally (e.g., along longitudinal direction L) or transversely (e.g., along transverse direction T) between the coupling 350 and the second member 242. In some embodiments, the second member 242 is integrally formed with the adapter 330. In still some embodiments, the adapter 330 includes a surface 352 configured to wrap around, press against, attach to, or latch onto the coupling 350. For instance, coupling 350 may include a collar 351 forming an articulatable surface for connection and disconnection of the coupling 350 and the conduit 500 (FIG. 5). The surface 352 at the adapter 330 may be connected to the collar 351, such as providing a connection at which articulation of the articulation mechanism 240 such as described herein selectively connects and disconnects the coupling 350 and the conduit 500.

In some embodiments, the coupling 350 is supported at the base 300 by a platform or member 354. The member 354 may form a stationary structure configured to retain at least a portion of the coupling 350 in position relative to the base housing 310. The member 354 may provide a surface against which the adapter 330 pushes or pulls against a connection or disconnection surface at the coupling 350.

Referring to FIGS. 3-5, in some embodiments, the articulation mechanism 240 includes a lever moveably attached to the first body 241. Referring to FIG. 3, the first body 241 may include a member or pin 243 extending from the first body 241 and configured to travel within a channel 244 formed at the articulation mechanism 240 forming the lever. In still some embodiments, the articulation mechanism 240 forming the lever is configured to bias in a downward direction, such as to require a user to squeeze or pull the articulation mechanism 240 upward (along vertical direction V, depicted in FIG. 2) to translate the first body 241. The upward force from the user may cause the articulation mechanism 240 to pivot at a pivot point 246 and generate a downward force to push the first body 241 downward via the pin 243 at the channel 244. For instance, pivot point 246 may be positioned between a first end 238 (FIG. 5) at which the user engages the articulation mechanism 240 (e.g., a handle) and a second end 239 (FIG. 5) at which the pin 243 is in the channel 244. The downward translation of the first body 241 contacts the second body 242 and pushes the adapter 330 downward. The downward translation of the adapter 330 articulates the coupling 350 to selectively disengage a manifold or conduit 500 (FIG. 5) from the coupling 350.

In various embodiments, the second body 242 is connected to the adapter 330. Body 242 and adapter 330 may be mounted on a rail 247, such as to facilitate translation along the vertical direction V. In some embodiments, body 242 and adapter 330 are coupled to a bearing 248. Bearing 248 may facilitate translation or sliding along the vertical direction V. Downard force along the vertical direction V by bodies 241, 242 and adapter 230 pushes down on the coupling 350, such as at collar 351, to release a gas connection. The body of the coupling 350 is held stationary and mounted to the base 300, such as via member 354.

Aforementioned embodiments may advantageously and beneficially utilize a users upward lifting motion (e.g., for picking up and removing the burner assembly 200) to disconnect the burner assembly 200 from the base 300 and the gas supply (e.g., gas supply 800 in FIG. 8).

In some embodiments, the articulation mechanism 240 is formed in the burner housing 230. For instance, the articulation mechanism 240 may be positioned within an opening 232 formed at a sidewall 234 of the burner housing 230. Sidewalls 234 at the burner housing 230 may form outer walls separated from one another along the longitudinal direction L (FIG. 1). The user may reach a hand or one or more digits into the opening 232 to access and articulate the articulation mechanism 240.

In still some embodiments, the base housing 310 may form a hand opening 312 providing access to the opening 232 at the burner housing 230 when the burner housing 230 is attached to, or being attached or removed from, the base housing 310.

In some embodiments, the base 300 includes a base wall 322 forming a bottom surface of the basin 320. The base wall 322 may form a conduit opening 324 through which the gas conduit 500 (FIG. 5) is extendable from the coupling 350 to the burner 210. The base wall 322 may form a body opening 326 through which the first body 241, the second body 242, or both, is extendable, such as to allow for communication of force from the first body 241, such as described above, through the base wall 322.

Figure 6:
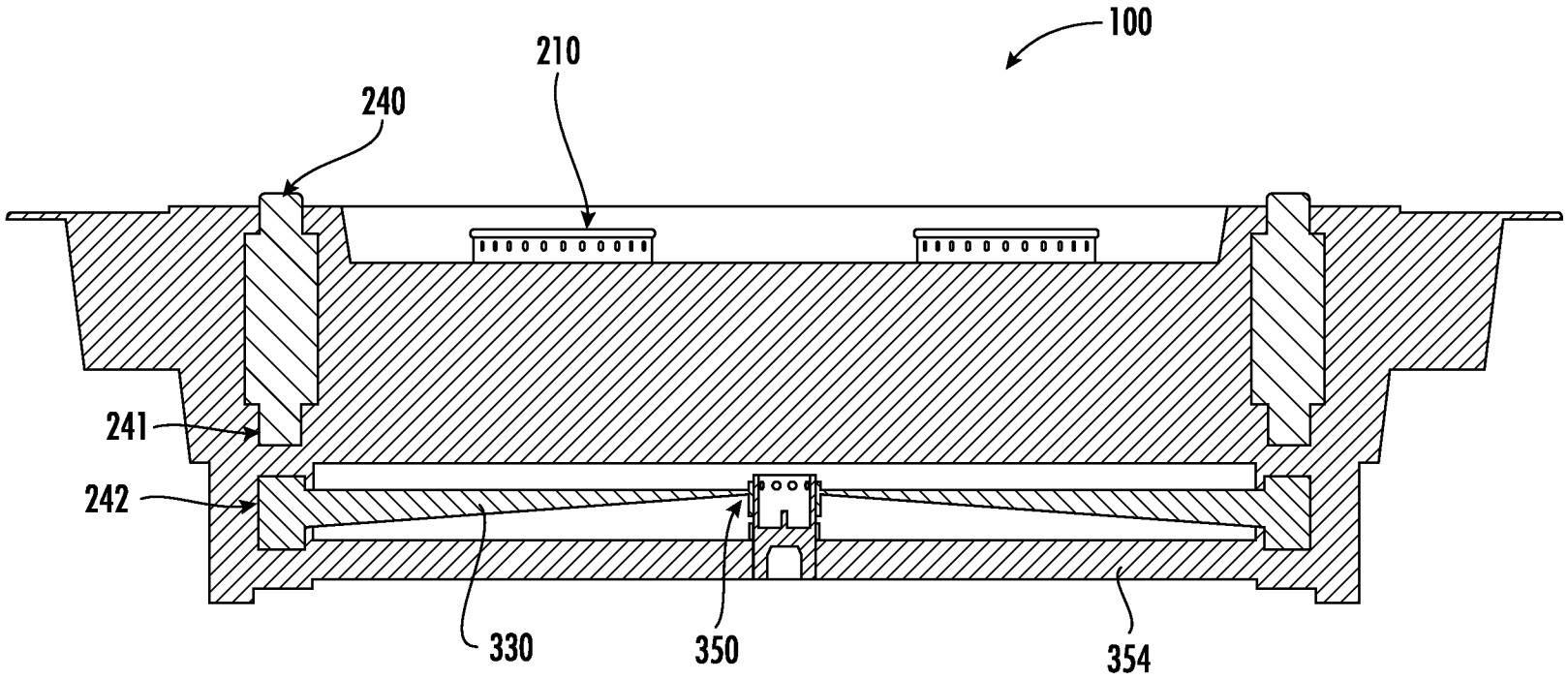
FIG. 6 depicts a side cutaway view of an embodiment of the gas cooktop assembly in accordance with aspects of the present disclosure.

Referring briefly to FIG. 6, in some embodiments, the articulation mechanism 240 may form a button at which the user may push downward. The articulation mechanism 240 is connected to the first body 241 such that downward force of the button pushes the first body 241 downward onto the second body 242 and the adapter 330 such as described above.

Referring back to FIGS. 1-5, embodiments of the articulation mechanism 240 may form the lever below (along the vertical direction V) the burner or cooking surface area, such as to allow for a reduction in overall dimension of the gas cooktop assembly 100 along the longitudinal direction L. The reduced overall dimension along the longitudinal direction L may further allow for a reduced dimension of the adapter 330 along the longitudinal direction L, such as may reduce stresses, reduce weight, reduce the cost of manufacturing, or improve durability at the adapter 330. Additionally, or alternatively, the articulation mechanism 240 positioned through openings 232, 312 may increase or maximize a ratio of cooking surface at burners 210 versus non-cooking surface adjacent to the burners 210 (e.g., along longitudinal direction L).

Embodiments of a gas cooktop assembly including the articulation mechanism 240 forming a lever such as described herein may increase the ratio of cooking surface to non-cooking surface over embodiments of a gas cooktop assembly including an articulation mechanism forming a button, such as depicted and described in regard to FIG. 6. Additionally, or alternatively, embodiments including the lever may reduce stress, reduce weight, reduce the cost of manufacturing, or improve durability of the adapter 330 over embodiments including the button.

In various embodiments, base wall 322 may form a leg opening 328 through which a leg 236 of the burner assembly 200 is receivable into leg 332 at the base 300, such as to nest leg 236 into leg 332. Legs 236, 332 may align the burner assembly 200 and the base 300 such that the quick connect valves (e.g., at coupling 250 and conduit 500) are aligned to one another. Additionally, or alternatively, nesting of legs 236, 332 may reduce the force from vibrations that may be transmitted to the coupling 250 or conduit 500, such as during movement of a recreational vehicle (e.g., in an embodiment depicted in FIG. 7B), or from other impact or handling of the gas cooktop assembly 100.

Referring to FIGS. 7A-7B, in some embodiments, embodiments of the gas cooktop assembly 100 provided herein may facilitate quick interchange between a grill or outdoor cooking appliance, such as depicted in FIG. 7A, to an indoor cooking appliance positioned within a countertop surface 710, such as depicted in FIG. 7B. Base 300 may form a portable component, such as for the outdoor cooktop appliance depicted in FIG. 7A. Additionally, or alternatively, base 300 may be installed into the countertop surface 710, such as depicted in FIG. 7B.

Referring to FIG. 8, burner assembly 200 may be utilized as a standalone appliance. For instance, leg 236 may contact a surface 810, such as, but not limited to, a table, ground, or countertop surface. The gas supply 800 may be directly connected to the burner assembly 200. The user may take the burner assembly 200 from standalone use and quickly install into the base 300 using the quick-connect/quick-disconnect mechanism to the coupling 350 such as described herein.

Embodiments of the gas cooktop assembly 100 depicted and described herein provide including structures for quick connection and disconnection to a gas supply. Embodiments of the gas cooktop assembly 100 provided herein allow for portability of the burner assembly 200, such as alternate between indoor usage (e.g., depicted in FIG. 7B) and outdoor usage (e.g., FIG. 7A or FIG. 8), or usage within a countertop (e.g., depicted in FIG. 7B) or at an outdoor cooking base (e.g., depicted in FIG. 7A. Embodiments provided herein may obviate a need for using tools (e.g., hand tools, wrenches, drivers, etc.) for connection or disconnection at the gas supply, allowing for quick and easy connection and disconnection to the gas supply or usage between indoor and outdoor usage. Embodiments provided herein may remove a need for a secondary outdoor gas cooktop appliance. Embodiments provided herein may facilitate common connection mechanisms for a recreational vehicle gas cooktop and outdoor gas cooktop (e.g., outdoor grill).

Further aspects and embodiments of the present disclosure are provided in the following clauses:

1. A gas cooktop assembly, including a burner housing including an articulation mechanism configured to translate a first body at the burner housing; and a base housing forming a basin into which the burner housing is receivable, the base housing including a second body to which the first body is translatable to articulate an adapter, the adapter connected to a gas coupling, wherein articulation of the adapter connects or disconnects the gas coupling and a gas conduit.

2. The gas cooktop assembly of any one or more clauses herein, wherein the articulation mechanism forms a lever configured to receive an upward force along a vertical direction and push the first body downward along the vertical direction to push the second body and the adapter downward along the vertical direction to connect or disconnect the gas coupling and the gas conduit.

3. The gas cooktop assembly of any one or more clauses herein, wherein the articulation mechanism forming the lever includes a pivot point positioned between a first end configured to receive the upward force and a second end including a channel at which a member is allowed to travel within the channel to translate force to the first body.

4. The gas cooktop assembly of any one or more clauses herein, wherein the gas coupling is supported at the base housing by a member, the member configured to retain the coupling in position relative to the base housing and allow a collar at the gas coupling to articulate to connect or disconnect the gas coupling and the gas conduit.

5. The gas cooktop assembly of any one or more clauses herein, wherein the second body and the adapter are mounted to a rail, and wherein the second body and the adapter are coupled to a bearing.

6. The gas cooktop assembly of any one or more clauses herein, wherein the base housing forms a base opening providing access to a burner opening at the burner housing when the burner housing is positioned in the basin, wherein the articulation mechanism is positioned at the burner opening at the burner housing.

7. The gas cooktop assembly of any one or more clauses herein, the base housing including a base wall at the basin, wherein the base wall forms a body opening through which the first body, the second body, or both, is extendable.

8. The gas cooktop assembly of any one or more clauses herein, wherein the base wall forms a conduit opening through which the gas conduit is extendable from the gas coupling to a burner at the burner housing.

9. The gas cooktop assembly of any one or more clauses herein, wherein the base wall forms a leg opening into which a leg at the burner housing is receivable into a leg at the base housing.

10. The gas cooktop assembly of any one or more clauses herein, wherein the base housing is separable from the burner housing by articulation of the adapter.

11. A gas cooktop assembly, including a burner assembly including a burner housing and a burner, wherein the burner housing includes a pair of sidewalls separated from one another along a longitudinal direction, wherein an articulation mechanism is positioned at each sidewall and configured to translate a first body at the burner housing, and wherein the burner assembly includes a gas conduit coupled in fluid communication with the burner; and a base selectively attachable to the burner assembly, the base including a base housing forming a basin into which the burner assembly is receivable, the base including a second body to which the first body is translatable along a vertical direction to articulate an adapter, the adapter extending along the longitudinal direction in connection to a gas coupling, wherein articulation of the adapter along the vertical direction connects or disconnects the gas coupling and the gas conduit at the burner assembly, and wherein articulation of the adapter attaches or detaches the base from the burner assembly.

12. The gas cooktop assembly of any one or more clauses herein, wherein the articulation mechanism forms a lever configured to receive an upward force along the vertical direction and push the first body downward along the vertical direction to push the second body and the adapter downward along the vertical direction.

13. The gas cooktop assembly of any one or more clauses herein, wherein the articulation mechanism forming the lever includes a pivot point positioned between a first end configured to receive the upward force and a second end including a channel at which a member is allowed to travel within the channel to translate force to the first body.

14. The gas cooktop assembly of any one or more clauses herein, wherein the gas coupling is supported at the base housing by a member, the member configured to retain the coupling in position relative to the base housing and allow a collar at the gas coupling to articulate to connect or disconnect the gas coupling and the gas conduit.

15. The gas cooktop assembly of any one or more clauses herein, wherein the second body and the adapter are mounted to a rail, and wherein the second body and the adapter are coupled to a bearing.

16. The gas cooktop assembly of any one or more clauses herein, wherein the base housing forms a base opening providing access to a burner opening at the burner housing when the burner housing is positioned in the basin, wherein the articulation mechanism is positioned at the burner opening at the burner housing.

17. The gas cooktop assembly of any one or more clauses herein, the base housing including a base wall at the basin, wherein the base wall forms a body opening through which the first body, the second body, or both, is extendable.

18. The gas cooktop assembly of any one or more clauses herein, wherein the base wall forms a conduit opening through which the gas conduit is extendable from the gas coupling to the burner.

19. The gas cooktop assembly of any one or more clauses herein, wherein the base wall forms a leg opening into which a leg at the burner assembly is receivable into a leg at the base.

20. The gas cooktop assembly of any one or more clauses herein, wherein the articulation mechanism forms a button configured to receive a downward force to translate to the first body, the second body, and the adapter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A gas cooktop assembly, comprising:

a burner housing comprising an articulation mechanism configured to translate a first body at the burner housing; and a base housing forming a basin into which the burner housing is receivable, the base housing comprising a second body to which the first body is translatable to articulate an adapter, the adapter connected to a gas coupling, wherein articulation of the adapter connects or disconnects the gas coupling and a gas conduit, and wherein the articulation mechanism forms a lever configured to receive an upward force along a vertical direction and push the first body downward along the vertical direction to push the second body and the adapter downward along the vertical direction to connect or disconnect the gas coupling and the gas conduit.

2. The gas cooktop assembly of claim 1, wherein the articulation mechanism forming the lever comprises a pivot point positioned between a first end configured to receive the upward force and a second end comprising a channel at which a member is allowed to travel within the channel to translate force to the first body.

3. The gas cooktop assembly of claim 1, wherein the gas coupling is supported at the base housing by a member, the member configured to retain the coupling in position relative to the base housing and allow a collar at the gas coupling to articulate to connect or disconnect the gas coupling and the gas conduit.

4. The gas cooktop assembly of claim 1, wherein the second body and the adapter are mounted to a rail, and wherein the second body and the adapter are coupled to a bearing.

5. The gas cooktop assembly of claim 1, wherein the base housing forms a base opening providing access to a burner opening at the burner housing when the burner housing is positioned in the basin, wherein the articulation mechanism is positioned at the burner opening at the burner housing.

6. The gas cooktop assembly of claim 1, the base housing comprising a base wall at the basin, wherein the base wall forms a body opening through which the first body, the second body, or both, is extendable.

7. The gas cooktop assembly of claim 6, wherein the base wall forms a conduit opening through which the gas conduit is extendable from the gas coupling to a burner at the burner housing.

8. The gas cooktop assembly of claim 6, wherein the base wall forms a leg opening into which a leg at the burner housing is receivable into a leg at the base housing.

9. The gas cooktop assembly of claim 1, wherein the base housing is separable from the burner housing by articulation of the adapter.

10. A gas cooktop assembly, comprising:

a burner assembly comprising a burner housing and a burner, wherein the burner housing comprises a pair of sidewalls separated from one another along a longitudinal direction, wherein an articulation mechanism is positioned at each sidewall and configured to translate a first body at the burner housing, and wherein the burner assembly comprises a gas conduit coupled in fluid communication with the burner; and a base selectively attachable to the burner assembly, the base comprising a base housing forming a basin into which the burner assembly is receivable, the base comprising a second body to which the first body is translatable along a vertical direction to articulate an adapter, the adapter extending along the longitudinal direction in connection to a gas coupling, wherein articulation of the adapter along the vertical direction connects or disconnects the gas coupling and the gas conduit at the burner assembly, and wherein articulation of the adapter attaches or detaches the base from the burner assembly, wherein the articulation mechanism forms a lever configured to receive an upward force along the vertical direction and push the first body downward along the vertical direction to push the second body and the adapter downward along the vertical direction.

11. The gas cooktop assembly of claim 10, wherein the articulation mechanism forming the lever comprises a pivot point positioned between a first end configured to receive the upward force and a second end comprising a channel at which a member is allowed to travel within the channel to translate force to the first body.

12. The gas cooktop assembly of claim 10, wherein the gas coupling is supported at the base housing by a member, the member configured to retain the coupling in position relative to the base housing and allow a collar at the gas coupling to articulate to connect or disconnect the gas coupling and the gas conduit.

13. The gas cooktop assembly of claim 10, wherein the second body and the adapter are mounted to a rail, and wherein the second body and the adapter are coupled to a bearing.

14. The gas cooktop assembly of claim 10, wherein the base housing forms a base opening providing access to a burner opening at the burner housing when the burner housing is positioned in the basin, wherein the articulation mechanism is positioned at the burner opening at the burner housing.

15. The gas cooktop assembly of claim 10, the base housing comprising a base wall at the basin, wherein the base wall forms a body opening through which the first body, the second body, or both, is extendable.

16. The gas cooktop assembly of claim 15, wherein the base wall forms a conduit opening through which the gas conduit is extendable from the gas coupling to the burner.

17. The gas cooktop assembly of claim 15, wherein the base wall forms a leg opening into which a leg at the burner assembly is receivable into a leg at the base.

18. The gas cooktop assembly of claim 10, wherein the articulation mechanism forms a button configured to receive a downward force to translate to the first body, the second body, and the adapter.

* * * * *